US005141168A

United States Patent [19]

Pepper

[11] Patent Number: 5,141,168

[45] Date of Patent: Aug. 25, 1992

[54] MACERATING MACHINE

[75] Inventor: Robert Pepper, Congleton, United Kingdom

[73] Assignee: Mono Pumps Limited, Audenshaw-Manchester, United Kingdom

[21] Appl. No.: 818,459

[22] Filed: Jan. 3, 1992

Related U.S. Application Data

[63] Continuation-in-part of Ser. No. 676,075, Mar. 27, 1991, abandoned.

[30] Foreign Application Priority Data

Apr. 30, 1990 [GB] United Kingdom ..... 9009646

[51] Int. Cl.[5] ..... B02C 18/16

[52] U.S. Cl. ..... 241/236; 241/295

[58] Field of Search ..... 241/236, 292.1, 295; 83/851, 852, 853, 854, 850

[56] References Cited

U.S. PATENT DOCUMENTS

| | | | |
|---|---|---|---|
| 2,259,015 | 10/1941 | Anderson et al. | 83/852 |
| 2,657,720 | 11/1953 | Wolfe | 83/854 |
| 3,880,361 | 4/1975 | Schwarz | 241/36 |
| 4,009,838 | 3/1977 | Tashman | 241/99 |
| 4,394,983 | 7/1983 | Ulsky | 241/243 |
| 4,399,946 | 8/1983 | Stevenson | 241/21 |

FOREIGN PATENT DOCUMENTS

| | | | |
|---|---|---|---|
| 20230 | 7/1956 | Fed. Rep. of Germany | 83/854 |
| 1226633 | 2/1960 | France . | |
| 0873966 | 10/1981 | U.S.S.R. | 241/292.1 |
| 1454288 | 11/1976 | United Kingdom . | |

*Primary Examiner*—Mark Rosenbaum
*Assistant Examiner*—John M. Husar
*Attorney, Agent, or Firm*—Fleit, Jacobson, Cohn, Price, Holman & Stern

[57] ABSTRACT

A cutter for a macerator of a type having first and second parallel contra-rotating shafts, each having a plurality of alternate cutters and spacers at the same axial thickness, the cutters of the first shaft being interleaved with those of the second shaft. The cutter of the invention has generally circumferentially spaced teeth 14, 16, 18, 22, each tooth having a front cutting face 26, 28, 30, 32, 34, and an inclined, generally ramp shaped rear face 46, 48, 50, 52, 54, which may be serrated. One tooth 14 has a "square" front face 26 which extends substantially parallel to the axis of the cutter while the front faces of the remaining teeth are inclined, preferably alternately, to the axis of the cutter.

12 Claims, 5 Drawing Sheets

MACERATING MACHINE

This is a Continuation-in-Part of application Ser. No. 07/676,075, filed Mar. 27, 1991 now abandoned.

The present invention relates to macerators and to a cutter for use in such a macerator.

One form of macerator includes first and second parallel contra-rotating shafts, each having a plurality of alternate cutters and spacers of the same axial thickness, the cutters of the first shaft being interleaved with those of the second shaft. Each cutter has a plurality of teeth arranged around its periphery at circumferentially spaced locations. According to GB-A-1569672 the teeth are each symmetrical with respect to a radial plane through the circumferential centre thereof. This is supposed to provide the advantage that the macerator can be reversed to give some form of clearing action and more importantly, when the leading edges of the teeth become worn, the cutters can be reversed so that the rear edges then become the leading edges. While this is apparently an advantage in theory, in practice it does not work out because, when the macerator is used in an abrasive environment, for example in macerating raw sewage, the cutters become worn by progressively becoming thinner. As this happens, the scissor action produced by the teeth of the cutters associated with the two shafts is greatly diminished and proper maceration does not take place.

The front faces of the cutters are inclined to the axis of the cutters, thus of the shaft associated therewith, and there can be a considerable tendency for the product being macerated to become jammed thereby seizing up the whole macerator.

It is now proposed, according to the present invention, to provide a cutter for a macerator of this type, the cutter having several circumferentially spaced teeth each tooth having a front cutting face and a generally ramp shaped, inclined, rear face, the front face of at least one tooth extending substantially parallel to the axis of the cutter and the front faces of a plurality of the other teeth being inclined to the axis of the cutter.

By having the back of the teeth inclined, if a jam begins to occur, or occurs, the macerator can be reversed and the ramp shaped rear faces urge the material being macerated radially outwardly toward the inlet, thereby relieving the jam.

Because at least one tooth has a "square" cutting face, it has been found that this improves catchment of the solids, and the drag of the item into the bank of cutters of the macerator. The other teeth have inclined faces and advantageously the teeth are inclined alternately to one side of the axis of the cutter and to the other side thereof. By having these alternate angles, an equalization of the side thrust on the cutters can be achieved this significantly reducing the possibility of breakage of the cutter teeth.

These front faces may be inclined at an angle of between 25° and 60° with respect to the axis of the cutter. It has been found advantageous, for example, with a five tooth cutter, to have an angle of about 30° and with a seven tooth cutter to have an angle of about 45°.

In order to assist in the cutting action, the front face of the teeth may be arcuately concave. This tends to retain an item to be cut as the teeth rotate.

The rear faces of the teeth may be serrated along at least part of their length and this assists in clearing solid matter during reversal of the cutters due to overload. It is has been found appropriate if the serrations define an angle 55° to 65° and preferably 60°.

The rear of the teeth may be arcuately convex for a portion of their length between the serrations of the tooth tip and this again assists in the clearing action.

To give a truly balanced cutting array, it is advantageous that only one tooth which has its front face extending substantially parallel to the axis of the cutter, the remaining teeth having their front faces inclined to the axis of the cutter.

The invention also provides a macerating machine having first and second parallel contra-rotating shafts, each having a plurality of alternate cutters and spacers of the same axial thickness, the cutters of the first shaft being interleaved with those of the second shaft, each cutter being a cutter of the invention.

In order that the present invention may more readily be understood, the following description is given, merely by way of example, reference being made to the accompanying drawings in which.

Figure 1:
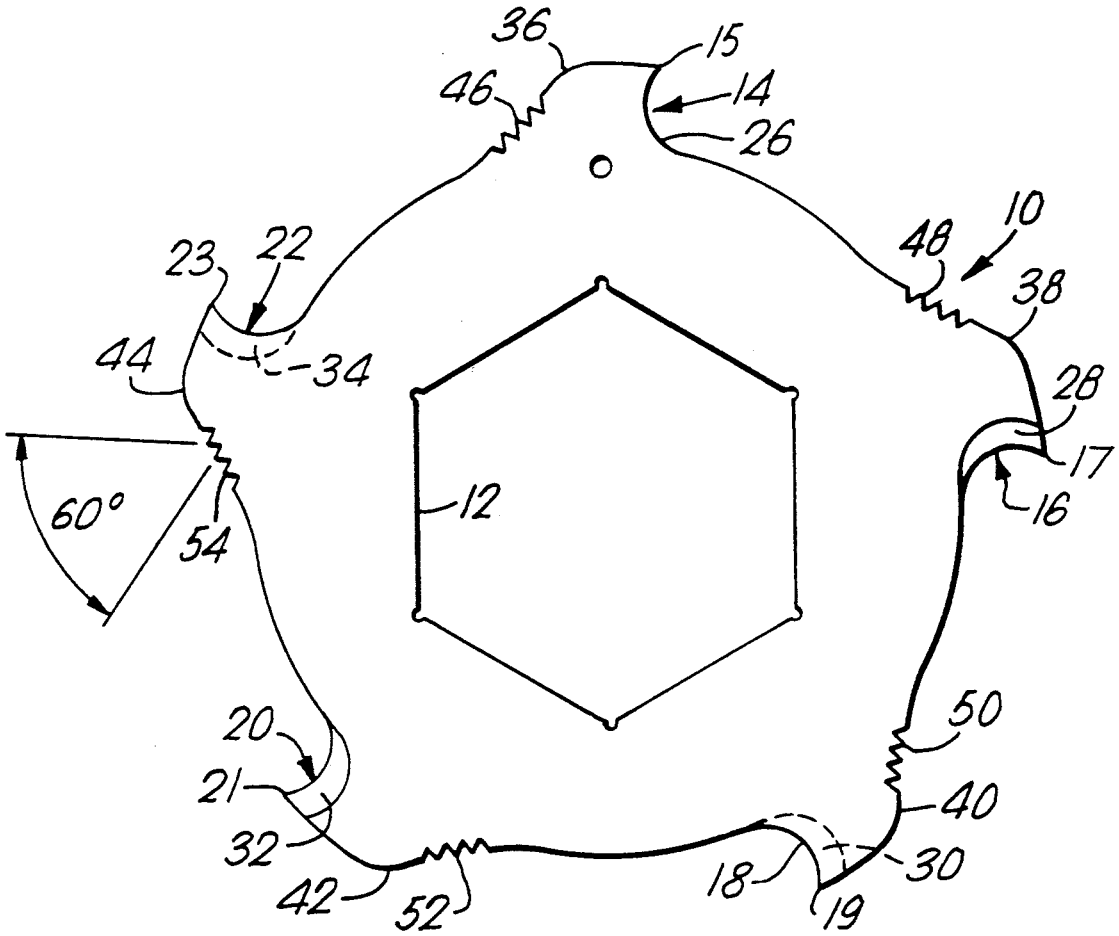
FIG. 1 is a side elevation of one embodiment of cutter according to the invention.

Referring first to FIG. 1, the cutter illustrated is to be mounted in a macerator of the type, for example, illustrated in GB-A-1569672. Such a macerator has two contra-rotating shafts upon which a plurality of cutters are mounted, there being inter-spaced between the cutters, spacers having substantially the same thickness as the cutters so that the cutters of one shaft interleave with those of the other to provide a good scissor action.

The cutter 10 illustrated in FIG. 1 is shown as having a central hexagonal opening 12 for engagement on the hexagonal shaft (not shown). The cutter is illustrated as having five circumferentially spaced teeth 14, 16, 18, 20, 22. It can be seen that each tooth has a tip 15, 17, 19, 21, 23 respectively and a generally arcuate concave front face 26, 28, 30, 32, 34. The front face 26 extends substantially parallel to the axis of the cutter, so that it is essentially "square". The front faces 28, 32 are angled to one side of the axis of the cutter and the alternate front faces 30, 34 are angled to the other side of the axis.

The rear faces 36, 38, 40, 42, 44 are inclined to provide a ramp-like configuration and are each provided with serrations 46, 48, 50, 52, 54, the angle of the serrations being approximately 60°. The rear faces 36–44 are arcuately convex between the serrations 46–54 and the tips 15–23.

It can be seen that the front faces 28, 30, 32, 34, are inclined at approximately 30° (see FIG. 2) to the axis 11 in alternately opposite directions. When a plurality of these cutters are mounted as shown, there is provided a good scissor action and it will be observed that the cutting action takes place only in the one direction of rotation. This is bound to make the cutter stronger and less prone to damage. Because the backs of the cutting teeth are inclined and serrated, this assists in clearing the solid matter during reversal of the cutters due to overload. The one tooth 14 has a "square" cutting face and this improves the catchment of the solids and the drag of the item being macerated into the bank of cutters. Because the other teeth have alternate angles this tends to equal out any side thrust and reduces the possibility of breakage.

It has been found that the overall diameter of the cutters of the present invention can be increased so that there is less clearance between the cutter and the spacer on the other shaft and this reduces the clearance between the teeth and the machine body also, thereby giving finer maceration.

Figure 2:
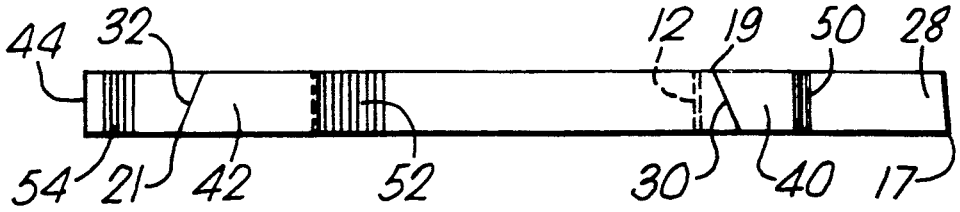
FIG. 2 is a view of the cutter of FIG. 1 from the edge.
Figure 3:
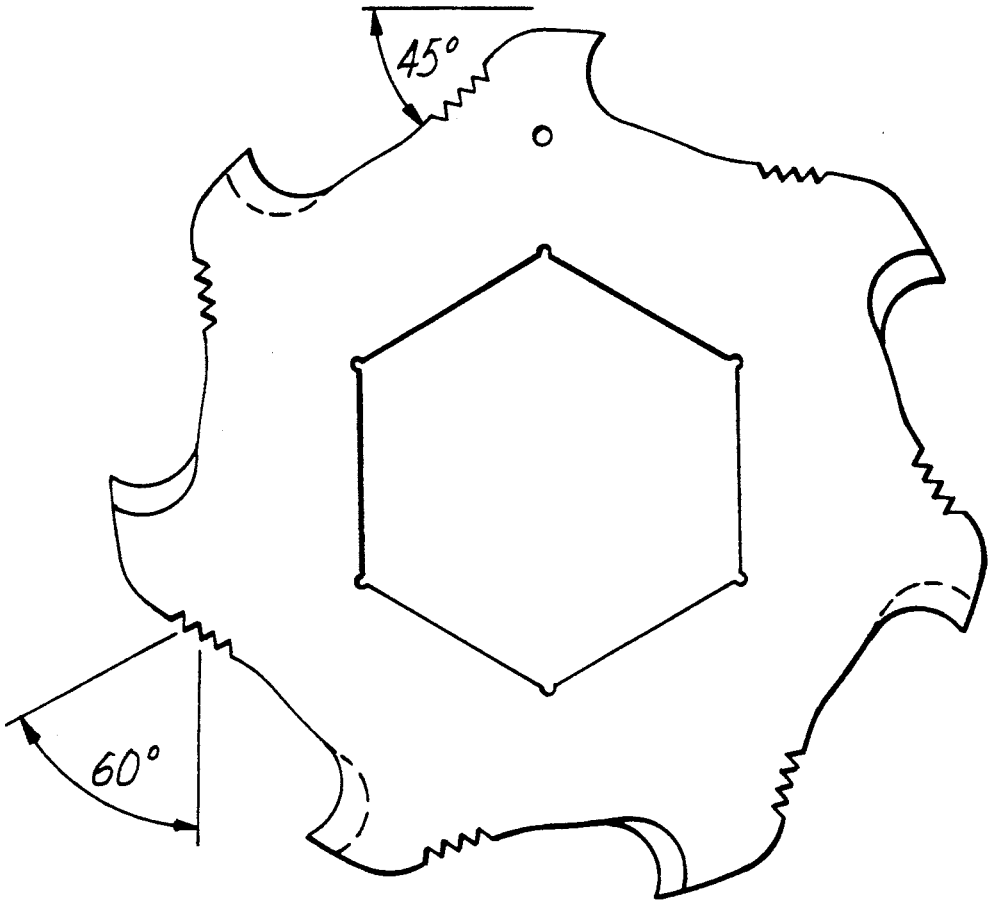
FIGS. 3 and 4 are views similar to FIGS. 1 and 2, respectively, of a second embodiment.
Figure 4:
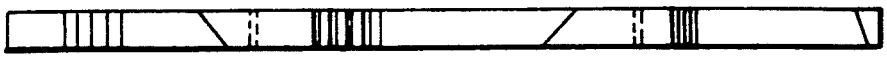

Detailed discussion of the construction of FIGS. 3 and 4 is not thought to be necessary because it is in many ways very similar to the cutter of FIGS. 1 and 2 except here seven teeth have been provided. Again one tooth is "square" and the other teeth are inclined in opposite angular directions. It has been found satisfactory here, because of the larger number of teeth, to have the angle of inclination of these cutters larger, for example approximately 45° to the axis of the cutter.

Figure 5:
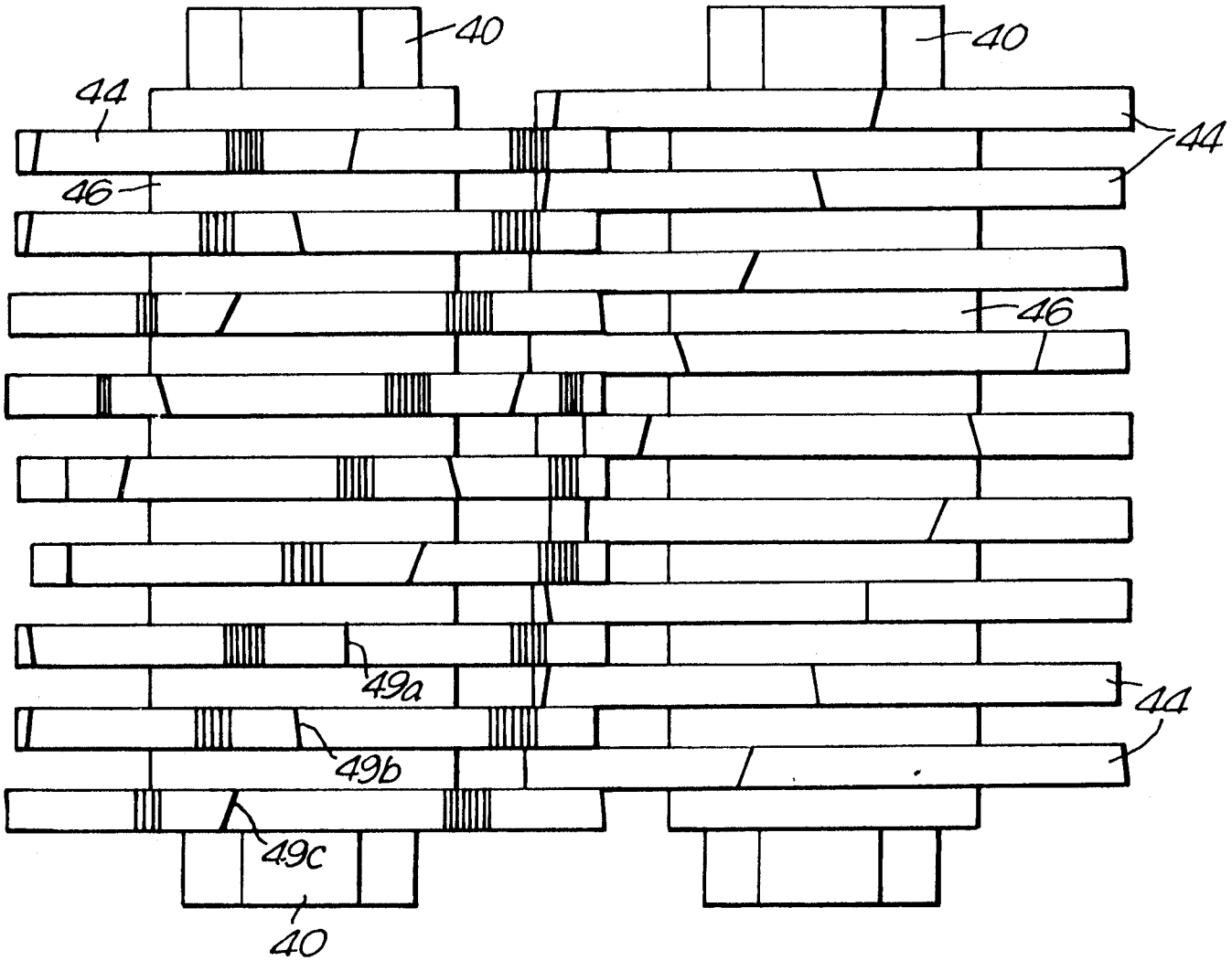
FIG. 5 is a side elevation of the cutters of one embodiment of macerator according to the invention mounted on their respective shafts.
Figure 6:
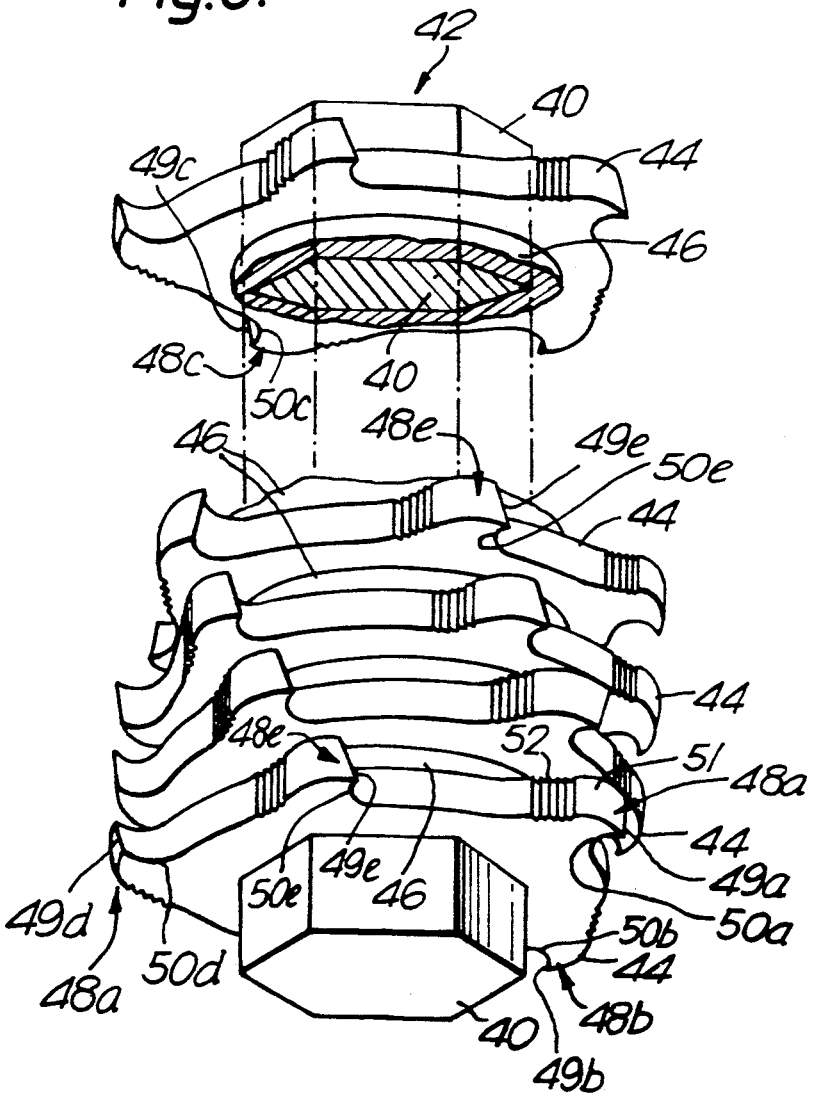
FIG. 6 is a schematic exploded perspective view of one of the stacks of macerator cutters of the macerator FIG. 5.
Figure 7:
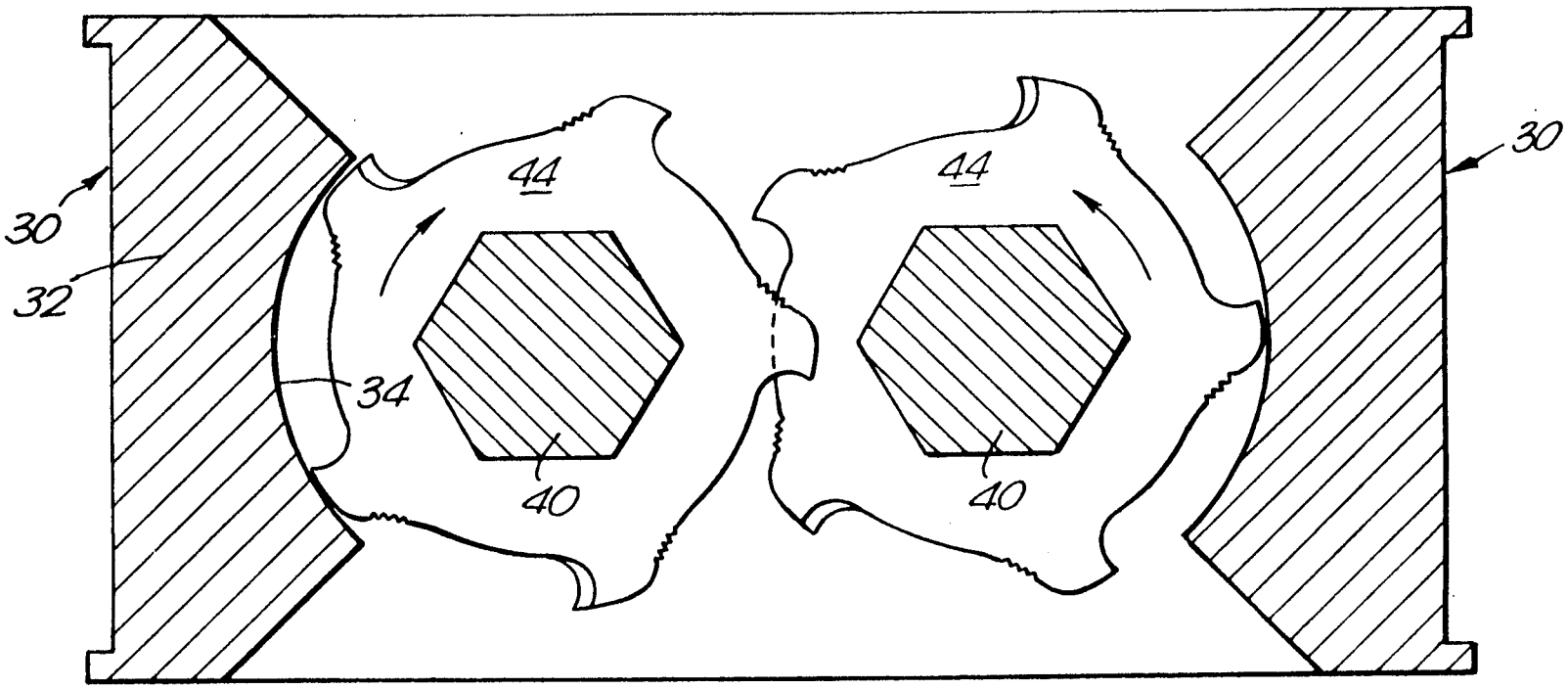
FIG. 7 is an end elevation, partly in section, through a macerator employing the stacks of cutters shown in FIGS. 5 and 6.

If reference is now made to FIGS. 5, 6 and 7 there is illustrated therein a macerator employing the cutters as shown in FIGS. 1 and 2.

If reference is first made to FIG. 7, it can be seen that there is on each side of a pair of stacks of cutters a side rail 30 having arcuate inner surface adjacent the peripheries of the teeth of the cutters this differs slightly from what is shown in GB-A-1569672 referred to above insofar as in that construction the side rails have a greater spacing from the cutters.

The cutters are indicated by the reference numeral 44 are each shown here mounted on hexagonal shafts 40. As there are in fact five teeth on each cutter and six faces on the hexagonal shaft 40, the teeth will be arranged in five helical arrays as shown in particular in FIG. 6.

As seen in FIGS. 5 and 6, each cutter of the stack is illustrated as having five circumferentially spaced teeth, as in the structure of FIGS. 1 and 2, these teeth here being indicated by the reference numerals 48*a*, 48*b*, 48*c*, 48*d*, 48*e*. It can be seen that each tooth has a tip 49*a*, 49*b*, 49*c*, 49*d*, 49*e* respectively and a generally arcuate concave front face 50*a*, 50*b*, 50*c*, 50*d*, 50*e*. The front face 50*a* and the top 49*a* extend substantially parallel to the axis of the cutter, as described above, so that it is essentially "square". The front faces 50*a*,50*b* are angled to one side of the axis of the cutter and the alternate front faces 50*c*, 50*e* are angled to the other side of the axis. The rear faces 51 are inclined to provide the ramp like configuration and are each provided with serrations 52, the angle for the serrations being approximately 60° as described above. The rear faces 51 are arcuately convex between the serrations 52 and the tips 49.

It will be appreciated that in each of the different types of cutters illustrated herein, the circumferential extent of each tooth from the front arcuate concave front face 50*a*, 50*b*, 50*c*, 50*d*, 50*e* to the rear most circumferential point of the rear face 51, and in particular adjacent the rear most of the serrations 52, is significantly less than the spacing between that rear most point of the rear face of one tooth than the front cutting face of the next adjacent tooth.

Looked at another way, the circumferential extent of the teeth in total is less than 50% of the circumference of the cutter disc, thereby enabling material to be macerated readily to move into the space in front of each tooth. Thus, relatively large items can easily enter the space in front of each tooth to be caught up by the concave face and dragged into the ever decreasing space between that concave face and the face of the adjacent teeth of the other stack and also the adjacent spacer 46 of the other stack.

I claim:

1. A cutter for a macerator of the type having first and second parallel contra-rotating shafts, each having a plurality of alternate cutters and spacers of the same axial thickness, the cutters of the first shaft being interleaved with those of the second shaft, said cutter comprising a plurality of circumferentially substantially equally spaced teeth, a front concave cutting face and a generally ramp shaped, inclined, rear face on each tooth, the circumferential extent of each tooth from the front concave cutting face thereof to the rear most circumferential point of the rear face thereof being less than the spacing between the rear most point of the rear face of one tooth and the front cutting face of the next adjacent tooth, the front face of at least one tooth extending substantially parallel to the axis of the cutter and the front faces of the other teeth being inclined alternatively to one side of the axis of the cutter and the other side of the axis of the cutter.

2. A cutter as claimed in claim 1, wherein the front faces of said other teeth are inclined at an angle of 25° to 50° with respect to the axis of the cutter.

3. A cutter as claimed in claim 1, wherein the rear faces of the teeth further comprise serrations along at least a part of their length.

4. A cutter as claimed in claim 3, wherein said serrations define an angle of 55° to 65°.

5. A cutter as claimed in claim 3, wherein the rear face of each tooth is arcuately convex for a portion of the length between the serrations and the tip of the tooth.

6. A cutter as claimed in claim 1, wherein there are an odd number of teeth, and wherein there is only one tooth which has its front face extending substantially parallel to the axis of the cutter, the remaining teeth having their front faces inclined to the axis of the cutter.

7. A macerator having first and second parallel contra-rotating shafts, each having a plurality of alternate cutters and spacers of the same axial thickness, the cutters of the first shaft being interleaved with those of the second shaft, each cutter comprising a plurality of circumferentially substantially equally spaced teeth, a front concave cutting face and a generally ramp shaped, inclined, rear face on each tooth, the circumferential extent of each tooth from the front concave cutting face thereof to the rear most circumferential point of the rear face thereof being less than the spacing between the rear most point of the rear face of one tooth and the front cutting face of the next adjacent tooth, the front face of at least one tooth extending substantially parallel to the axis of the cutter and the front faces of the other teeth being inclined alternatively to one side of the axis of the cutter and to the other side of the axis of the cutter.

8. A macerator as claimed in claim 7, wherein the front faces of said other teeth are inclined at an angle of 25° to 50° with respect to the axis of the cutter.

9. A macerator as claimed in claim 7, wherein the rear faces of the teeth further comprise serrations along at least a part of their length.

10. A macerator as claimed in claim 9, wherein said serrations define an angle of 55° to 65°.

11. A macerator as claimed in claim 9, wherein the rear face of each tooth is arcuately convex for a portion of the length between the serrations and the tip of the tooth.

12. A macerator as claimed in claim 7, wherein there are an odd number of teeth, and wherein there is only one tooth which has its front face extending substantially parallel to the axis of the cutter, the remaining teeth having their front faces inclined to the axis of the cutter.

* * * * *